US005558539A

United States Patent [19]

Lignelet

[11] Patent Number: 5,558,539

[45] Date of Patent: Sep. 24, 1996

[54] METHOD AND DEVICE FOR PROVIDING ELECTRICAL CONTINUITY OF CABLE SHIELDING

[75] Inventor: Jacky Lignelet, Coudoux, France

[73] Assignee: Eurocopter France, Marignane Cedex, France

[21] Appl. No.: 327,433

[22] Filed: Oct. 21, 1994

[30] Foreign Application Priority Data

Oct. 22, 1993 [FR] France ..... 93 12616

[51] Int. Cl.[6] ..... H01R 13/648

[52] U.S. Cl. ..... 439/610; 174/35 R

[58] Field of Search ..... 439/98, 99, 610; 174/35 R, 95

[56] References Cited

U.S. PATENT DOCUMENTS 5,419,271 5/1995 Lignelet ..... 439/701
5,437,564 8/1995 Lignelet ..... 439/701

FOREIGN PATENT DOCUMENTS 3913544 10/1990 Germany .
WO91/20112 12/1991 WIPO .

OTHER PUBLICATIONS

Design Engineering, "Multi-screened termination simplifies and shortens repair," Dec. 1992, London, England, p. 13.

*Primary Examiner*—Gary F. Paumen
*Attorney, Agent, or Firm*—Marshall, O'Toole, Gerstein, Murray & Borun

[57] ABSTRACT

An electrical connection element intended for the electrical connection of shielded bundles of electrical cables wherein at least some of the electrical cables are shielded. The connection element is composed of an outer tube and an inner tube. The outer robe has a hollow interior space and a first portion adapted to be joined to a bundle of electrical cables having a shield, the electrical cables passing through the hollow internal space of the outer tube. The outer tube has a second portion adapted to be joined to a connector associated with the bundle of electrical cables and intended to make electrical connection with an interacting connector associated with at least one other bundle of electrical cables. The shield of the bundle of electrical cables surrounds the outer tube and is in contact with an external face of the outer tube. The inner tube has a diameter smaller than that of the outer tube, and the inner tube is fixed coaxially to the outer tube to establish electrical linkage between the inner and outer tubes.

8 Claims, 4 Drawing Sheets

METHOD AND DEVICE FOR PROVIDING ELECTRICAL CONTINUITY OF CABLE SHIELDING

BACKGROUND OF THE INVENTION

The present invention relates to a method for providing electrical continuity of the shielding when electrically connecting shielded cable bundles, as well as the connection obtained by the implementation of this method. In addition, the invention relates to an electrical connection element appropriate to the implementation of the method.

For the transmission of information and control signals, especially in aircraft such as helicopters, electrical cable bundles, also called "harnesses", must be formed. In such harnesses, approximately 25% of the electrical cables used are shielded cables, which include one or more conductors. The shielding of these cables, which is generally joined to the overall ground of the aircraft, is necessary in order to limit interference, either by radiation of the signals which they carry, risking disturbance to the environment, or because of their sensitivity to the radiation coming from the environnent. Often these harnesses are themselves surrounded by a shield, this making it possible to provide an overall protection of all the cables forming said harnesses, whether the cables are shielded or unshielded.

It is easy to understand the difficulties which arise when connecting such bundles in order to provide electrical continuity of the shielding. In fact, because of the sometimes very large number of shields in a bundle, it is necessary to provide a correspondingly large number of means for establishing electrical linkage with each of said shields.

In a known manner, an electrical linking conductor is connected to the shield of each of the shielded cables, for example by means of a heat-soldering sleeve which includes a solder ring arranged beneath a heat-shrinkable tubing. These electrical linking conductors are equipped, at their free end, with a connection pin intended to come into contact with an interacting connection pin joined to the shield of another bundle, when electrically connecting these bundles.

According to another known solution, bridges between the various shields are made, also be means of electrical linking conductors, so as to electrically join them to each other, this enabling only a single connection pin to be used for the linkage to another bundle, but this requiring, however, as previously, soldered joints to be made between the shields and the associated electrical linking conductors.

These known solutions have many drawbacks. In particular, the linking conductors and the heat-soldering sleeves occupy a significant and space-consuming volume. In addition, the installation of these elements requires the execution of a certain number of operations to be carried out separately, and this is so for each shielded cable, these operations having to be carried out manually and not automatically, or at least with great difficulty, this preventing complete automation of the manufacture of the bundles.

SUMMARY OF THE INVENTION

The object of the present invention is to overcome these drawbacks and the invention relates to a method making it possible to provide electrical continuity of the shielding when electrically connecting shielded cable bundles, without recourse to the difficult and space-consuming arrangement, as explained previously, of electrical linking conductors.

For this purpose, the method for providing electrical continuity of the shielding, when electrically connecting electrical cable bundles by means of the usual interacting connectors associated with each of the bundles, at least some of the electrical cables being shielded and each of the shielded cables including a metal shield surrounded by an insulating outer jacket, is noteworthy, according to the invention, in that, for each of the electrical cable bundles:

- each of said shielded cables is stripped, at least partially, by removing the insulating outer jacket over a stripping zone;
- the shielded cables, with their stripped zones, are arranged in a conductive connection element intended to be connected to the connector associated with the electrical cable bundle; and
- the shielded cables are rendered integral with connection element by means of a fixing means which is electrically conductive and which makes it possible to ensure, in addition, that the stripped zones and the connection element are electrically linked together.

Thus, electrical continuity of the shielding, from one bundle to another bundle, is obtained directly by mechanically linking each connection element with the associated connector and by connecting the interacting connectors, this making it possible to eliminate the connection pins used in the known devices for providing electrical linking of the shields. In addition, the method in accordance with the invention avoids, in particular, the difficult and space-consuming arrangement of the electrical linking conductors used in the known devices, this providing very many advantages.

In fact, this method makes it possible, particular, to reduce:

- the manufacturing time for the bundles;
- the weight of the bundles, because of the elimination of the electrical linking conductors and of the heat-soldering sleeves;
- the volume of the connectors, because of the elimination of the connection pins; and also
- the overall cost of the bundle.

By way of example, a recent study has established that the use of the method in accordance with the invention on a TIGRE military helicopter makes it possible to eliminate 1214 connection points in the central part of the apparatus and, therefore, an equal number of heat-soldering sleeves, as well as to eliminate more than 121 meters of shielding wire inside the connectors. This particular example clearly shows the significant advantages obtained by the invention.

Furthermore, the method for providing electrical continuity of the shielding when electrically connecting shielded electrical cable bundles is noteworthy, according to the invention, when the bundles are themselves protected by a shield, in that, for each of the electrical cable bundles, the shield of the bundle is rendered integral with the connection element by means of a fixing means, establishing electrical linkage.

Thus, electrical continuity of the shielding of the bundles is established, in an identical manner to that for the shielding of the various shielded cables, by electrical linkage to the connection element.

The present invention also relates to an electrical connection element intended for the implementation of the method in accordance with the invention, the connection element being joined, via one of its ends, to a bundle of shielded cables to be connected and, via the other end, to a connector associated with the bundle and intended to make the electrical connection with an interacting connector associated with at least one other bundle of shielded cables.

In accordance with the invention, the end of the connection element facing the bundle is made in the form of a tube, the cables of the bundle passing through the hollow internal space of the tube and the shield of the bundle surrounding the tube, in contact with the external face of the latter.

According to a first embodiment of the connection element, the tube is equipped with through-holes, enabling the shields of the shielded cables to pass from the hollow internal space to the outside, in order to fix them to the external face of the tube.

According to a second embodiment, the connection element includes an inner tube, of smaller diameter than the tube, which is fixed coaxially with the latter, with establishment of electrical linkage between the two tubes.

Preferably, in the longitudinal direction, the tube is longer than the inner tube, on the side of the connector, and shorter on the opposite side.

Advantageously, the connection element is made in two symmetrical parts, this making it easier to make connection element and also to automate the manufacture of the bundles.

The tubes may have shapes which are varied in cross section, for example a circular section or an oval section, this enabling the connection elements to be matched to the shape of the bundle or to that of the associated connector. For the same purpose, the connection element may include a transverse base plate enabling this connection element to be connected to an electrical connector equipped with a module holder and with a wiring chamber, like, for example, the one described in French Patent Application 93/03975 or the one described in French Patent Application 93/03976.

The object of the present invention is also to specify and to improve the connection obtained by the implementation of the method in accordance with the aforementioned invention. For this purpose, advantageously, the connection element is not a separate element but forms part of the connector.

Furthermore, the fixing means may, for example include a cable-clamping ring combined, if necessary, with conductive adhesive, or a conductive tubing, in particular a tubing made of a material known commercially by the name Viton.

Advantageously, for the connection using the connection element in accordance with the first aforementioned embodiment and including a single tube equipped with through-holes, the shield of the bundle and the shields of the cables are fixed jointly by the same fixing means to the external face of the tube.

Moreover, for the connection using the connection element in accordance with the second aforementioned embodiment and including two coaxial tubes, the unshielded cables advantageously pass through the hollow internal space of the inner tube, the shielded cables pass through the space between the inner tube and the tube and are fixed to the external face of the inner tube, and the shield of the bundle is fixed to the external face of the tube.

However, this connection element in accordance with the second embodiment may be used differently. It is possible, in fact, to provide for the electrical cables to pass through the hollow internal space of the inner tube and for the shield of each of the shielded cables to be connected to an individual electrical conductor, the individual electrical conductors going around the end of the inner tube facing the connector and being fixed to the external face of the inter tube, the shield of the bundle being fixed to the external face of the tube.

Although one of the main aims of the invention is to eliminate the electrical linking conductors, it will be noticed that it is, nevertheless, possible to envisage, in some cases, by using the connection element in accordance with the invention as described previously, to make use of individual linking conductors.

The figures of the appended drawing will make it easy to understand how the invention may be realized. In these figures, identical references designate like elements.

DETAILED DESCRIPTION OF THE PREFERRED EMBODIMENTS

Figure 1:
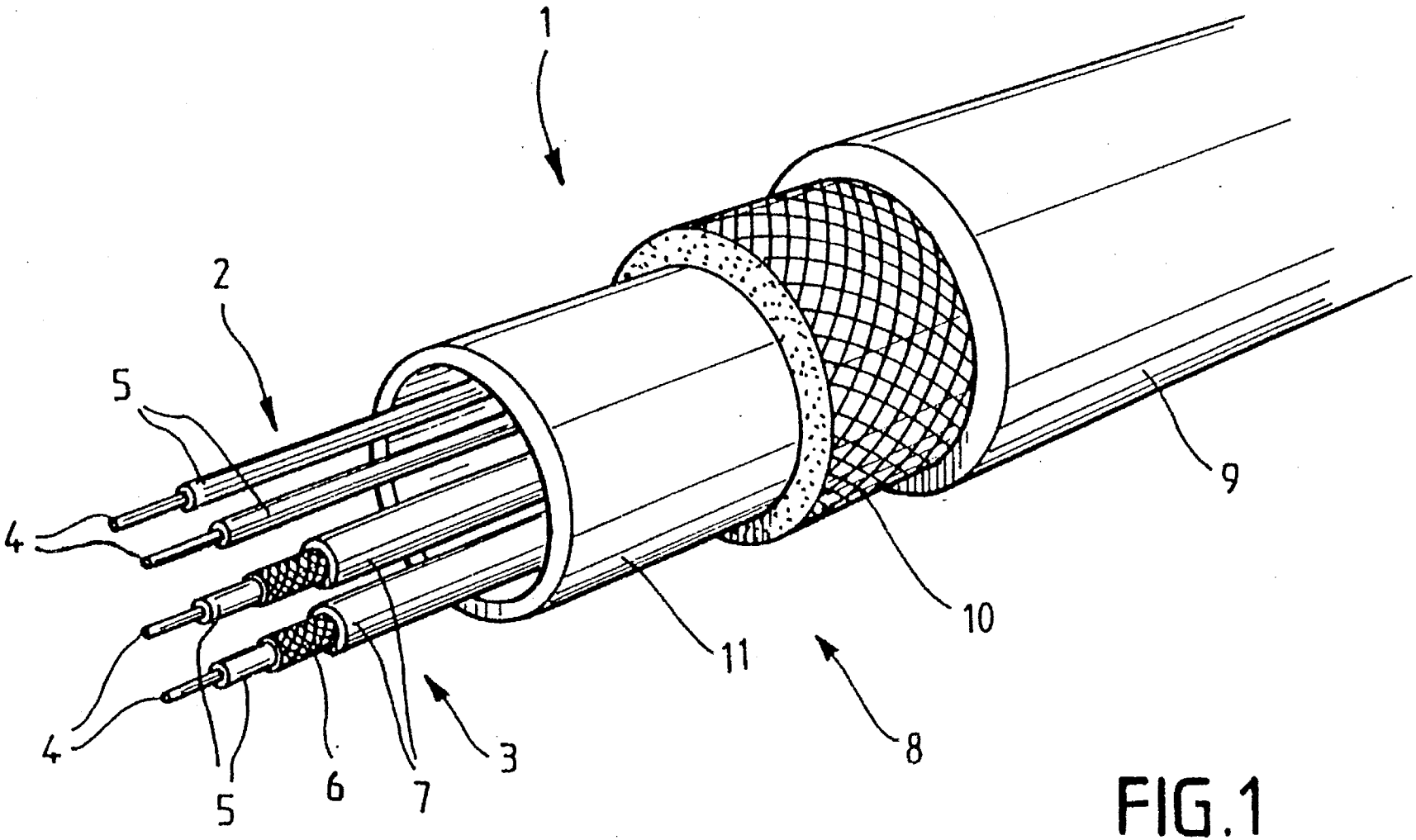
FIG. 1 is a perspective view of the end of an electrical cable bundle.

The object of the present invention is to provide electrical continuity of the shielding when electrically connecting shielded cable bundles identical to the bundle 1 depicted in FIG. 1.

The bundle 1 includes electrical cables 2, 3, some of which are shielded and others unshielded. The unshielded cables 2 consist of at least one electrical conductor 4 surrounded by an insulating sheath 5, for example made of plastic. As for the shielded cables 3, these include, from the inside to the outside, in addition to an electrical conductor 4 and an insulating sheath 5 identical to those of the unshielded cables 2, a metal shield 6, for example made of copper, and an insulating jacket 7.

As a security measure, in particular for protecting the bundle 1, both against mechanical stresses and against electromagnetic radiation, the bundle 1 is surrounded by a protective casing 8 which includes, from the outside to the inside:

- a protective jacket 9, made of insulating material, mechanically protecting the bundle 1 from the environment;
- a shield 10 made, for example, in the form of a metal braid; and
- a protective jacket 11, made of a material identical to that of the protective jacket 9, for the mechanical protection of the cables 2, 3 with respect to the shield 10.

Electrical connection of an electrical cable bundle 1 to at least one other similar bundle, by means of usual interacting connectors, requires electrical linkage of the shields 6 of the shielded cables 3 and of the shield 10 to the corresponding shields of the other bundle.

Figure 2:
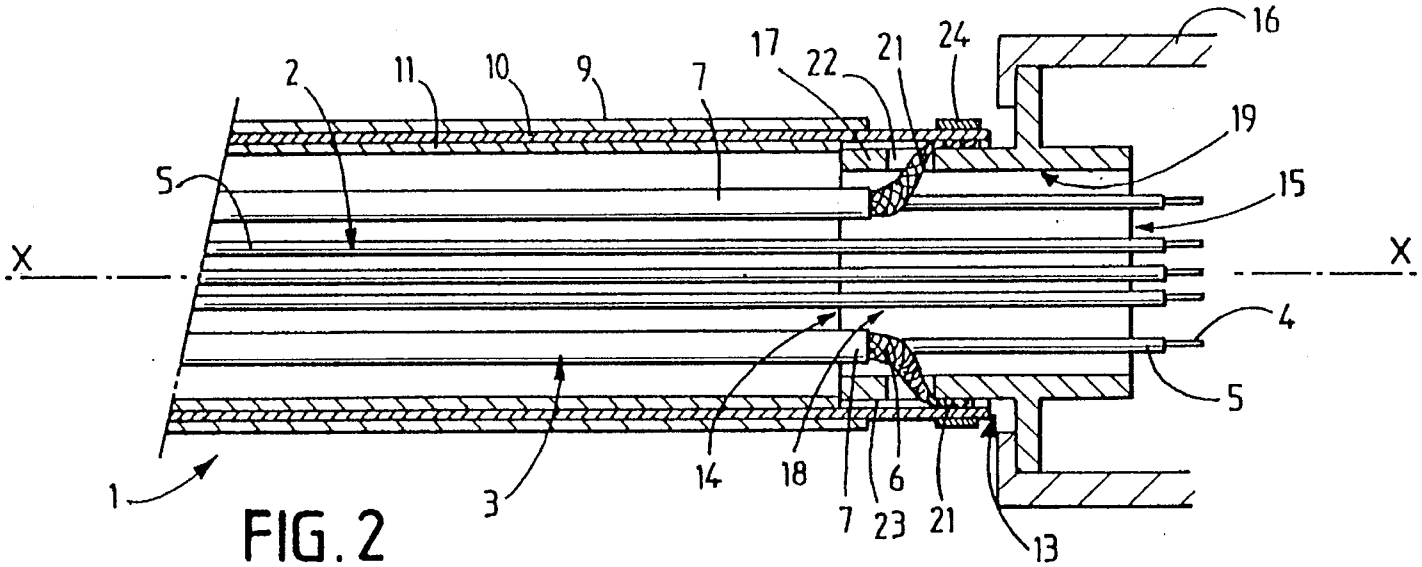
FIG. 2 is a partial longitudinal section illustrating diagrammatically the connection in accordance with the invention of an electrical cable bundle by means of a connection element made according to a first embodiment.
Figure 3:
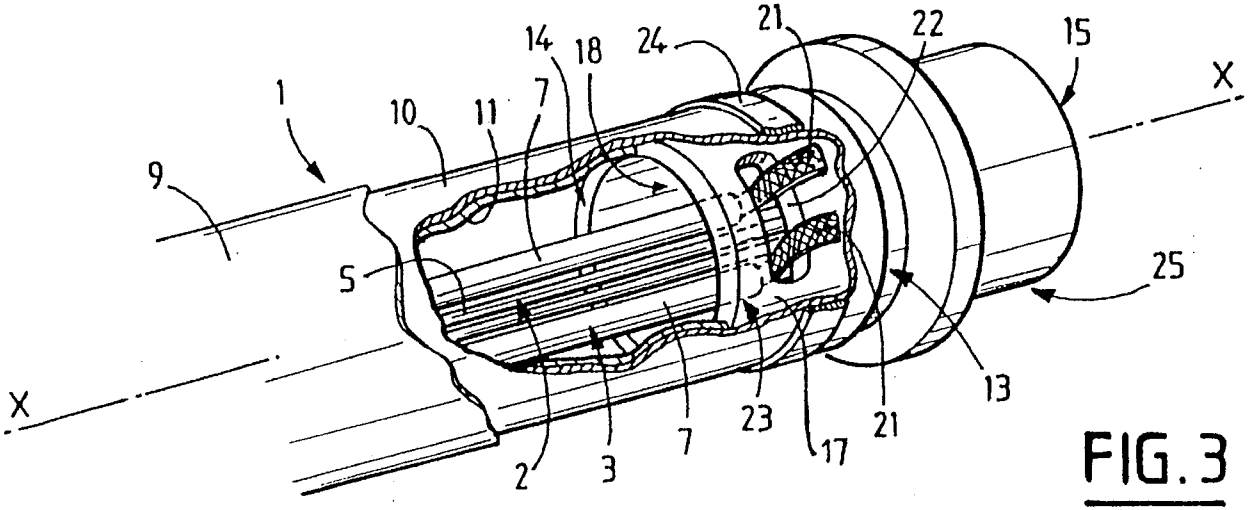
FIG. 3 is a perspective view of a connection similar to that of FIG. 2 with partial cutaway in the region of the connection element.

According to the invention, this electrical continuity of the shielding is obtained by associating, with each of the bundles to be connected, an electrical connection element 13 made from a conductive material and depicted in FIGS. 2 and 3 in a first embodiment. Said electrical connection element 13 is integral, by means of one 14 of its ends, with the bundle 1 to be connected and, by means of the other end 15, with a conductive element 16 which will be explained below and which is associated with the usual electrical connector (not depicted) used for the connection.

The connection element 13 includes, at its end 14, a tube 17, of axis X—X, of circular section and of external diameter close to that of the protective jacket 11 of the casing 8 of the bundle to be connected. The cables 2 and 3 of the bundle are directed through the hollow internal space 18 of the tube 17, the shielded cables 3 being radially distributed close to the internal face 19 of the tube 17, and the unshielded cables 2 being arranged close to the axis X—X.

For each of the shielded cables 3, the following operations are carried out, at the connection element 13, close to its end 14:

- the insulating jacket 7 is removed toward the connector, thus baring the shield 6;
- the shield 6 is loosened from the corresponding cable 3, for example by means of a longitudinal cut (not depicted); and
- the shield 6 is cut so as to leave remaining a tongue 21 (the length of which will be specified hereinbelow) connected to the shield but loosened from the cable 3.

It will be noticed that all the electrical cables of the bundle 1, both the shielded cables and the unshielded cables, are directed towards the connector and now only include the electrical conductor 4 surrounded by the insulating jacket 5.

The tube 17 is equipped with oblong through-holes 22 spaced apart and distributed radially in a plane (not depicted) transverse to the tube.

The tongues 21 of the various shielded cables 3 distributed radially close to the internal face 19 of the tube 17 pass through the oblong openings 22 and are brought into contact with the external face 23 of the tube 17.

The tongues 21 are covered there by the shield 10 of the bundle 1, of slightly greater diameter than the diameter of the tube 17. In the case where the respective diameters do not correspond exactly, it is, of course, easy to adapt the shield 10 to the diameter of the tube 17, for example by making a longitudinal cut in the shield 10.

The shield 10 and the tongues 21 are jointly fixed to the tube 17 by means of a single fixing means 24, for example a cable-clamping ring or a tubing, which surrounds the shield 10 (after stripping the protective jacket 9) and which enables electrical linkage between the shields 6 and 10 and the connection element 13 to be established.

As mentioned previously, the connection element 13 is connected, at its face 15 opposite the bundle 1, to a conductive element 16 associated with the connector and depicted diagrammatically in FIG. 2, so as to show clearly that it may have a plurality of shapes adapted each time to the connector used. It may, for example, consist of a linking element, such as an axially movable screw (not depicted) which can be arranged on a tubular end 25 of the connection element (FIG. 3), enabling the connection element to be removably joined to the connector. However, other solutions are possible, as will be seen hereinbelow. Thus, for example, the conductive element 16 may form part of the body of the connector and the linkage between this conductive element 16 and the connection element 13 may be rigid, so that the connection element itself then forms an integral part of the connector.

Consequently, electrical continuity of the shielding of one bundle to another bundle, when making electrical connection, is obtained by mechanically linking each connection element with the associated connector and by connecting the interacting connectors together.

The connection element 28, in accordance with the invention and depicted in FIGS. 4 to 8, is obtained according to another embodiment, but it is also intended to be connected, like the connection element 13 of FIGS. 2 and 3, on the one hand, to the shields of a bundle 1 and, on the other hand, to an associated connector (not depicted). The connection element 28, of axis Y—Y, includes, at its end 29 facing the bundle 1, two tubes 30 and 31 of circular section and of different diameters. The tubes 30 and 31 are arranged, coaxially with the axis Y—Y, these being offset with respect to each other in the direction of the axis Y—Y so that the tube 31, of smaller diameter, is extended further toward the bundle 1 and extended less toward the connector than the tube 30. These tubes 30 and 31 are furthermore joined together by conductive walls 32 and 33 respectively fixed to each of the tubes.

The connection element 28 is fixed by its face 34 opposite the bundle 1 to a transverse base plate 35, enabling it to be joined to an electrical connector equipped with a module holder and with a wiring chamber, identical to the connectors described in French Patent Applications 93/03975 and 93/03976.

Figure 6:
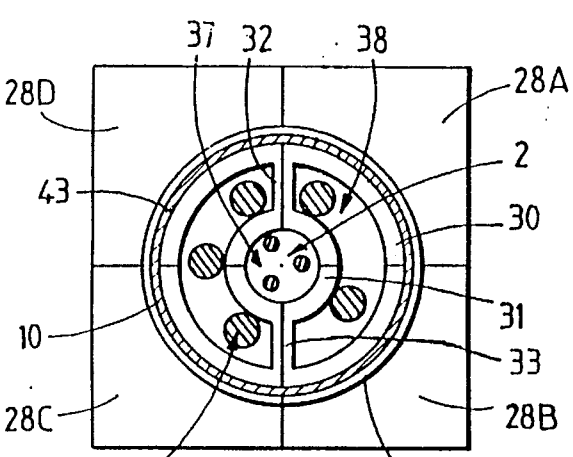
FIG. 6 is a cross section, along the line VI—VI of FIG. 4, showing the connection element in accordance with the invention.
Figure 8:
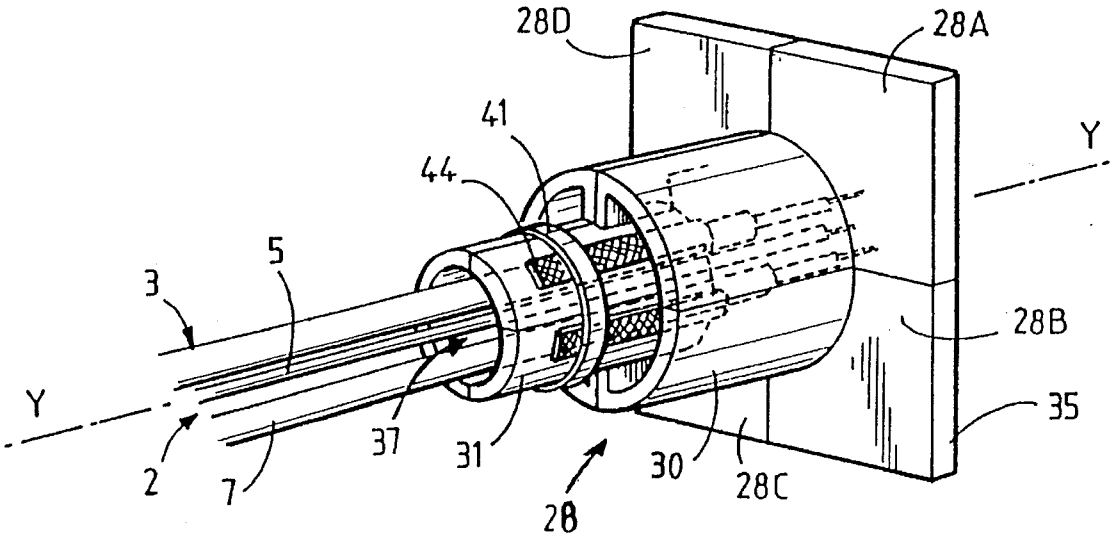
FIG. 8 is a perspective view showing the connection element used for the connection of FIG. 7.

In order to make it easier to manufacture the connection element 28, as well as to automate the connecting, the connection element 28 consists of four identical segments 28A, 28B, 28C and 28D fixed together (see, for example, FIGS. 6 and 8). According to another embodiment, the connection element consists only of two parts, for example a first part formed by segments 28A and 28B and a second part formed by segments 28C and 28D.

Figure 4:
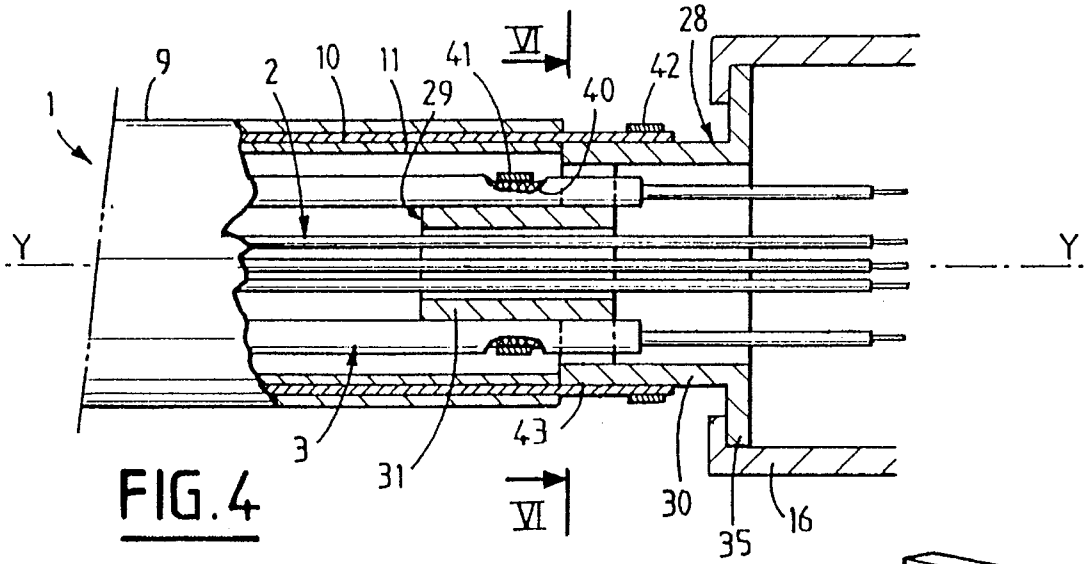
FIG. 4 is a partial longitudinal section illustrating diagrammatically the connection in accordance with the invention of an electrical cable bundle by means of a connection element made according to a second embodiment.
Figure 5:
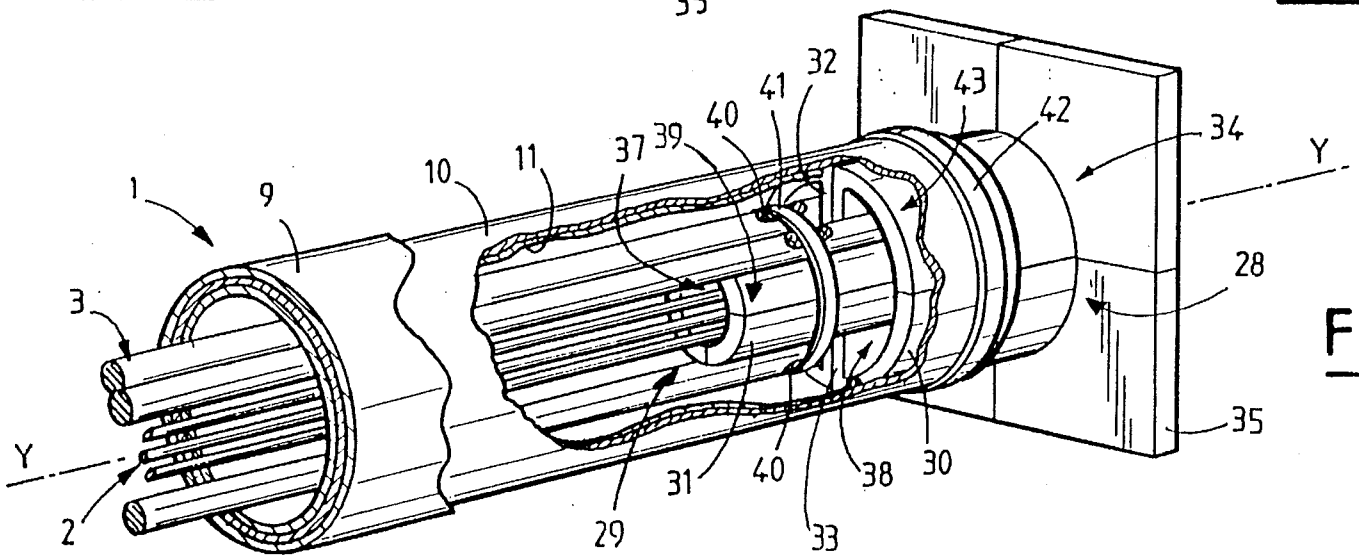
FIG. 5 is a perspective view of a connection similar to that of FIG. 4 with partial cutaway in the region of the connection element.

According to a first way of connecting the shields to the connection element 28, as depicted in FIGS. 4 to 6, the unshielded cables 2 are directed through the hollow internal space 37 of the tube 31, while the shielded cables 3 are directed through the space 38 between the two tubes 30 and 31. The shielded cables 3 are, furthermore, radially distributed and are brought into contact with the external face 39 of the tube 31. Each of shielded cables 3 is stripped over a stripping zone 40, thus baring the shield 6, the zones 40 being distributed in a place (not depicted) transverse to the axis Y—Y. The cables 3 are fixed to the external face 39 of the inner tube 31 by a conductive fixing means 41 surrounding the cables in the region of the stripped zones 40. Since the fixing means 41 is, moreover, in contact with the tube 31, it enables electrical linkage between the connection element 28 and the shields 6 of the cables 3 to be established.

Moreover, the tube 30 has a diameter substantially equal to the jacket 11 of the casing 8 of the bundle. For this reason, the shield 10 of the bundle is fixed to the external face 43 of the tube 30 by a fixing means 42, in a manner identical to the fixing of the shield 10 to the external face 23 of the tube 17, as depicted in FIGS. 2 and 3, thus establishing electrical contact between the shield 10 and the connection element 28.

Figure 7:
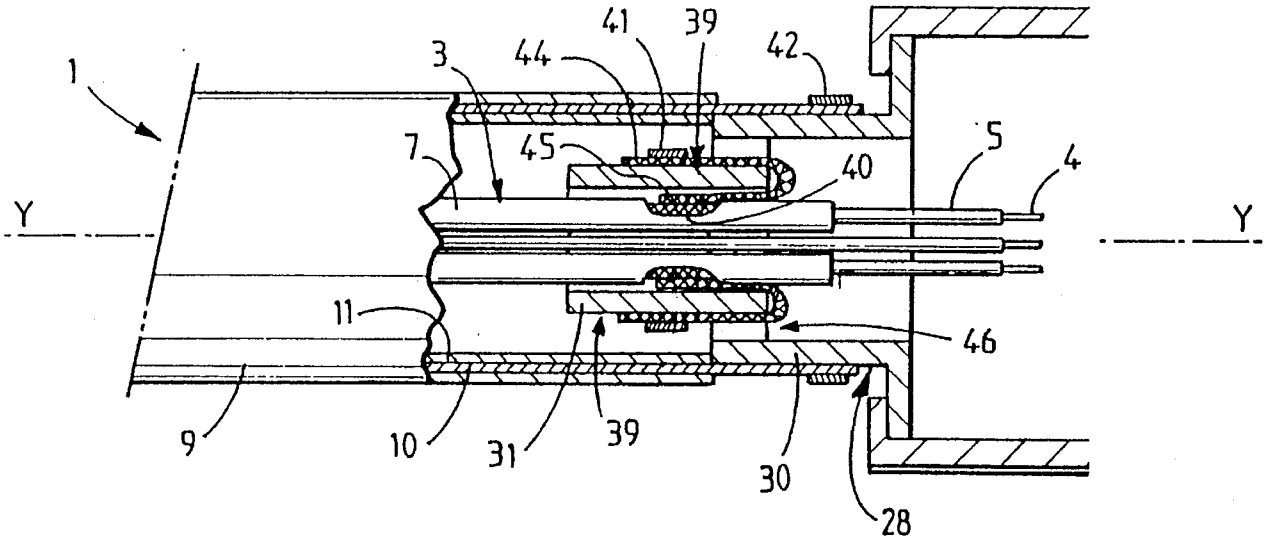
FIG. 7 is a partial longitudinal section illustrating another mode of connection using the connection element of FIG. 4.

According to a second way of connecting the shields to the connection element 28, as depicted in FIGS. 7 and 8, all the electrical cables of the bundle, both the unshielded cables 2 and the shielded cables 3, are directed through the hollow internal space 37 of the inner tube 31, the unshielded cables 2 being arranged close to the axis Y—Y and the shielded cables 3 being radially distributed towards the outside. For the purpose of simplifying the drawing, FIGS. 7 and 8 have depicted the tube 31 with a greater diameter than in FIGS. 4 to 6. Associated with each of the shielded cables 3 is an electrical conductor 44 fixed, for example by soldering, by one 45 of its ends to the stripped zone 40 of the corresponding shielded cable 3. The electrical conductors 44 go around the end 46 of the inner tube 31 opposite the bundle 1 and are brought into contact with the external face 39 of the tube 31 in order to be fixed thereto by the fixing means 41.

These electrical conductors 44 thus establish electrical linkage between the various shields 6 of the shielded cables 3 and the connection element 28. As regards the shield 10 of the bundle 1, not depicted in FIG. 8 in order to simplify the drawing, this is joined to the tube 30 in an identical manner to the previous fixing mode depicted in FIGS. 4 to 6.

I claim:

1. An electrical connection element intended for the electrical connection of shielded bundles of electrical cables, at least some of said electrical cables being shielded, said connection element comprising:

an outer tube having a hollow interior space and a diameter, said outer tube having a first portion adapted to be joined to a bundle of electrical cables having a shield, said electrical cables passing through said hollow internal space of said outer tube, said outer tube having a second portion adapted to be joined to a connector associated with said bundle of electrical cables and intended to make electrical connection with an interacting connector associated with at least one other bundle of electrical cables, said shield of said bundle of electrical cables surrounding said outer tube and being in contact with an external face of said outer tube, and an inner tube having a diameter smaller than said diameter of said outer tube, said inner tube being fixed coaxially to said outer tube to establish electrical linkage between said inner and outer tubes.

2. The electrical connection element as claimed in claim 1, wherein said inner tube has a first end and a second end, said first end of said inner tube being disposed with an interior portion of said outer tube and said second end of said inner tube being disposed outside of an interior portion of said outer tube.

3. The electrical connection element as claimed in claim 1, wherein said outer tube has a circular section.

4. The electrical connection element as claimed in claim 1, wherein said outer tube has an oval section.

5. The electrical connection element as claimed in claim 1, wherein said connection element is formed of two symmetrical parts.

6. The electrical connection element as claimed in claim 1, additionally comprising a transverse base plate adapted to be connected to an electrical connector equipped with a module holder and a wiring chamber.

7. A connection of shielded bundles of electrical cables, some of said electrical cables being shielded and some of said electrical cables being unshielded, using an electrical connection element as claimed in claim 1, wherein said unshielded cables pass through a hollow internal space of said inner tube, wherein said shielded cables pass through a space between said inner tube and said outer tube and are fixed to an external face of said inner tube, and wherein said shield of said bundle is fixed to said external face of said outer tube.

8. The connection of shielded bundles of electrical cables, at least some of said electrical cables being shielded, using an electrical connection element as claimed in claim 1, wherein said electrical cables pass through hollow internal space of said inner tube, wherein the shield of each of said shielded cables is connected to an individual electrical conductor, said individual electrical conductors going around an end of said inner tube facing said connector and being fixed to said external face of said inner tube, and wherein said shield of said bundle is fixed to said external face of said outer tube.

* * * * *